US005713176A

United States Patent [19]

Hunt

[11] Patent Number: 5,713,176

[45] Date of Patent: Feb. 3, 1998

[54] COMBINATION METAL AND COMPOSITE STUD

[76] Inventor: Donald Patrick Hunt, 4811 Mill Creek Dr., Colleyville, Tex. 76034

[21] Appl. No.: 547,791

[22] Filed: Oct. 25, 1995

[51] Int. Cl.[6] ..... F04C 3/092

[52] U.S. Cl. ..... 52/731.5; 52/731.9; 52/731.1; 52/481.1; 52/376

[58] Field of Search ..... 52/731.1–731.5, 52/731.9, 483.1, 481.1, 653.1, 656.9, 664, 733.2, 376, 238.1, 243.1, 243

[56] References Cited

U.S. PATENT DOCUMENTS

| | | | |
|---|---|---|---|
| 3,037,593 | 6/1962 | Webster | 52/731.1 X |
| 4,001,993 | 1/1977 | Daniels | 52/733.3 X |
| 4,034,535 | 7/1977 | Postmann | 52/731.4 X |
| 4,444,525 | 4/1984 | Alander | 52/656.9 X |
| 5,210,990 | 5/1993 | Kirk, Jr. | 52/664 |
| 5,331,786 | 7/1994 | Lippert | 52/731.1 |
| 5,417,023 | 5/1995 | Mandish | 52/731.5 X |
| 5,452,556 | 9/1995 | Taylor | 52/931.9 X |
| 5,590,505 | 1/1997 | Bogle | 52/731.1 X |
| 5,609,006 | 3/1997 | Boyer | 52/731.5 X |
| 5,625,997 | 5/1997 | Callahan et al. | 52/731.1 X |

FOREIGN PATENT DOCUMENTS

| | | | |
|---|---|---|---|
| 5163786 | 6/1993 | Japan | 52/483.1 |

*Primary Examiner*—Carl D. Friedman
*Assistant Examiner*—Winnie Yip
*Attorney, Agent, or Firm*—John P. Halvonik

[57] ABSTRACT

A combination C-shaped or U-shaped metal and composite construction stud for commercial and residential types of buildings. The stud may be made of various gauge galvanized structural or non-structural steel and has an insert made of softer material located at strategically placed points on the stud. Such softer materials may include wood, composite materials, plastic or fiberglass combinations. Pointed fastening devices such as nails and/or screws may then be used to fasten other structural components to the stud such as wall panels and other commonly used materials. Nails may be used at the blocking points of the stud and screws where there is no blocking.

4 Claims, 3 Drawing Sheets

COMBINATION METAL AND COMPOSITE STUD

BACKGROUND AND FIELD OF THE INVENTION

The invention relates to the field of building construction as well as the construction of other static structures. In particular, the invention is directed toward the common building member known as a "stud". In particular, a stud that has both hard and soft material components with the most likely combination of these being wood and or steel. It follows from the foregoing that a conveniently usable and inexpensive substitute for wooden studs is needed, and the present invention embodies such a substitute. By using this combination structural metal and composite material/stud that attaches to wooden top and bottom plates with conventional wood framing tools and techniques, the possibility of combining a combination composite and metal stud with conventional wood joists and rafters becomes a probability. "Toe nailing" techniques are believed to be an important method of attaching the stud described herein. The invention is believed to have the greatest utility in the construction of buildings, domestic homes and other common residential and light commercial structures.

A main objective for designing this stud is so that metal and wood may be used in connection with each other to build a better building and at the same time, help to recycle materials such as, steel, plastics, and wood materials. The term "toe nailing" is a method of fastening a stud to the top and bottom plates is the real idea behind the invention. By having a top and a bottom block inserted into the steel stud, the stud may now be used in connection with the wood stud or used as its own entity.

It has long been the custom to construct the skeletal portions of small buildings such as residences or small commercial buildings from wooden or metal components. A wood building consists of approximately 95% wood frame members and a metal building consisting of approximately 95% metal members. Using a combination of metal members and wood members together in such construction has not been perfected or accepted by builders and, hence, buildings are built with either substantially all wood or, substantially all metal frameworks.

Wood is becoming scarce and is subject to destruction by rot and termites. Using an all metal structure requires the use of bolts or screws and skilled professional laborers hence, becoming time consuming and enhancing labor costs. Wood is easier to use because it is easy to fasten. Using a composite stud combination that may be used in conjunction with both materials will decrease the likelihood of termites attacking the wood members and also have the fastening advantages that wood has. In essence, the structure may have metal studs with wood top and bottom plates, wood or steel joists, and wood or steel rafters or any combination the builder chooses to use.

The present invention is designed to provide both wood and metal materials in each stud and, of course, it follows that a building made with such members will have a skeletal structure that reflects both types of materials. It is believed that the invention described herein may find use in both commercial and/or residential types of buildings.

The stud described herein will satisfy both the needs of the residential builder and the light commercial builder. Also, it will help save our forests by lowering the amount of wood members used in small buildings and at the same time will make the buildings more structurally sound, termite resistant, and fire retardent, plus it will help recycle metal, wood, and plastic materials to be used here domestically.

Toe nailing is a process whereby nails are driven into wooden members and secured to one another by hammering the nail through the top or bottom plate and into the blocked ends of the stud. This is one type of fastening method that uses nails. Other fastening methods are also possible in connection with the stud described herein.

It is thought that the member or stud may be rolled from any gauge steel commonly used in the industry. Different gauges of steel are governed by national, international and local codes and they will designate the use of the member stud combination.

The terms: "insert" and "blocking" both refer to the wood, plastic or similar type of soft material insert that is shaped to fit inside the cavity in the stud. A good substitute for wood in this invention would be e.g. a recycled plastic product. By "soft material" it is meant a material like those listed above that is softer than metal and having the same characteristics of wood for fastening devices received.

It is believed that by using this combination metal and composite material stud, wooden top and bottom plates may be attached to the stud with conventional wood framing tools and techniques such as "toe-nailing." Also, the use of such studs described herein is believed to be an ecological wise one, for the use of such a stud may decrease the costs of producing an all wood or all metal stud as recycled metal products and composite materials may be used in the stud.

In addition to wood, other soft composite materials such as, plastics, wood, pulp, and fiberglass, etc. may be used for the insert.

DESCRIPTION OF THE PRIOR ART

While there are structural members that have been made out of both wood and metal, there are none that applicant is aware of that use smaller wood (or other soft material) as inserts within the stud. The use of inserts requires smaller pieces of wood that are not as expensive as full length wood pieces would be.

SUMMARY OF THE INVENTION

The invention relates to structural or non-structural members, commonly called studs, and comprises an elongated metal member having a main wall with two side walls extending from opposite edges of the main wall. Both side walls extend parallel to one another and are on the same side of the main wall. When the metal member is viewed in cross section the main wall and side walls form an open cavity running the length of the elongated metal member. Soft material inserts may then be secured to the metal member by placement within this cavity, with various placements of the inserts. The topmost and bottom most of these soft inserts are used to attach the stud to other structural members of the frame by toe nailing, for example.

Such fastening methods may be e.g. by toe-nailing. This practice is commonly used in the industry, for holding studs and other members with the use of common nails, screws, and/or both, thus incorporating the use of common inexpensive labor. The soft inserts may be secured in the metal frame either by gluing, crimping, wedging, or by screwing or nailing.

The inserts are formed of a soft material that would permit commonly used fastening means, such as a nail or screw, to be attached to the member/stud and thus allow one to connect the stud to other structural members. Such fastening process may be by toe-nailing. More than two inserts may be located in the cavity and secured to the elongated metal member. The member or stud may be rolled from any gauge steel commonly used in the market place today.

It is the object of the invention to provide a structural member such as a stud having a metal frame with either a C-shaped or a U-shaped cross section that thus forms a cavity for holding an insert made of wood or other soft composite materials. Such inserts may be attached at specific positions along the stud to allow the attachment of the stud to other structures in the frame.

It is an object of the invention to help save our forests by decreasing the amount of wood that is used in studs and thus decrease the amount of wood used in buildings. At the same time allowing a combination of both.

Another objective is to provide construction members for buildings that are made of both metal and wood material so that buildings will not have a skeleton that is all wood or all metal.

Another object is to increase structural soundness of buildings and make them more fire retardent.

Another object is to encourage the recycling of both metal and plastic materials by finding use for such materials in the building industry.

Other objectives of the invention will be understood to those skilled in the art once the invention is shown and described.

DESCRIPTION OF THE PREFERRED EMBODIMENT

Figure 4:
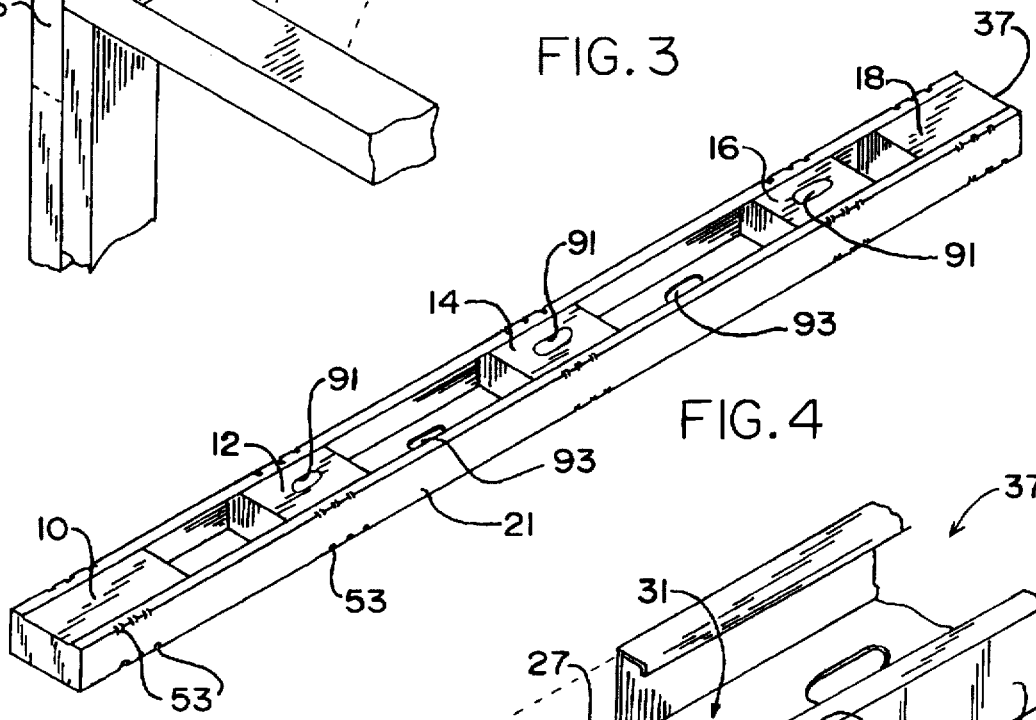
FIG. 4 is an isometric view of a structural member/stud showing electrical pre-drilled holes with blocking behind the holes as to not allow the wire to fray and plumbing holes where there is no insert or blocking.
Figure 5:
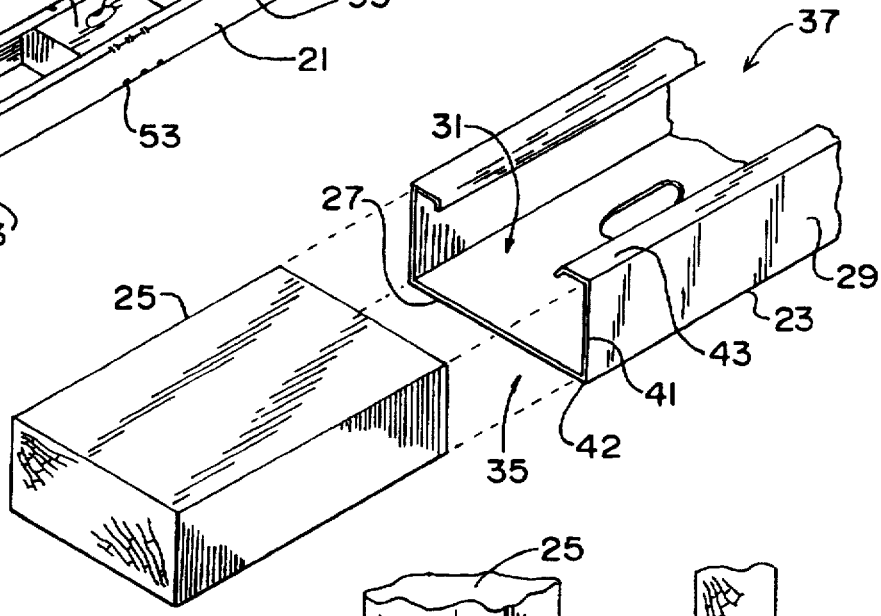
FIG. 5 illustrates an insert blocking to be located in the cavity of a member/stud of the invention whether the insert be of composite material or common wood products.
Figure 6:
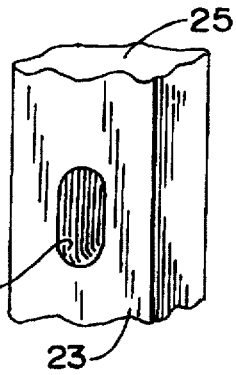
FIG. 6 illustrates a punched hole formed through the metal wall and insert of the member/stud of the invention through which electrical wires at the inserted blocking points may be run without problem of wire fraying. Electrical wire will not touch raw punched edge of metal because of the blocking.
Figure 7:
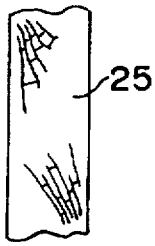
FIG. 7 cross-section of FIG. 6.
Figure 10:
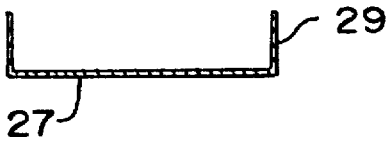
FIG. 10 U-shaped cross section of a metal stud taken along line 10 in FIG. 9.
Figure 11:
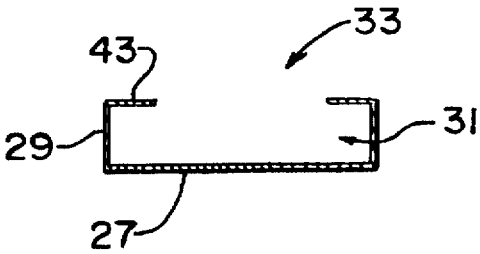
FIG. 11 C-shaped cross section of a metal stud taken along line 10 in FIG. 9.

The overall construction of the stud is as shown in FIG. 4. The overall stud is identified by reference numeral 21. It comprises a metal frame 23 having cavities and a plurality of wood or plastic insert members 25. The metal frame 23 of FIGS. 2 and 4–7 has a C or U-shaped cross section having a main wall 27 and two side walls 29 extending from the same side of the wall 27. The frame thus forms a cavity 31 having an opening 33 along its length and two openings 35 and 37 at opposite ends of the frame (see FIG. 10 and 11 for cavity 31). Each of the side walls 29 comprises a first portion 41 which extends from a side edge 42 of the wall, a second portion 43 which extends parallel to wall 27 and a gripping portion 45 which extends in a downward direction toward the main wall 27.

Figure 9:
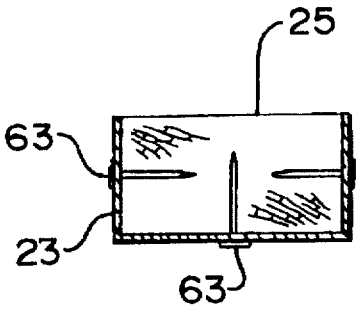
FIG. 9 illustrates nails used to attach anything to the structural or non-structural member/stud at the blocking point.

The wall portions 41 are parallel to each other and the wall portions 43 extend toward each other. The metal frame 23 may be formed of any gauge galvanized steel such that nails and dry wall screws may be driven and screwed through the wall thereof. The inside dimensions of the frame 23 may be of any conventional size stud with insert 25 for blocking designed to fit thereof. The length of the frame 23 may be any nominal length defined as a stud. As shown in FIG. 4, the inserts 25 may be secured in the cavity at the desired positions by crimps 53 made in the side edges of the frame 23. The inserts may also be secured by the gripping portions 45 or by wedging or gluing A U-shaped frame may be used instead of a C-shape frame as shown in FIG. 9. The inserts 25 may be held in place in the cavity by driving nails 63 through the walls 27 and 41 into the insert. This would be an alternative method for securing the insert or blocking.

The insert 25 may be formed of material that is able to be penetrated by fastening means in use nowadays. For example: wood or soft plastic material maybe used for the inserts. Such inserts are formed into blocks such that a fastening means, such as a nail or screw, may be embedded in or driven through the insert and held in place therein.

Figure 8:
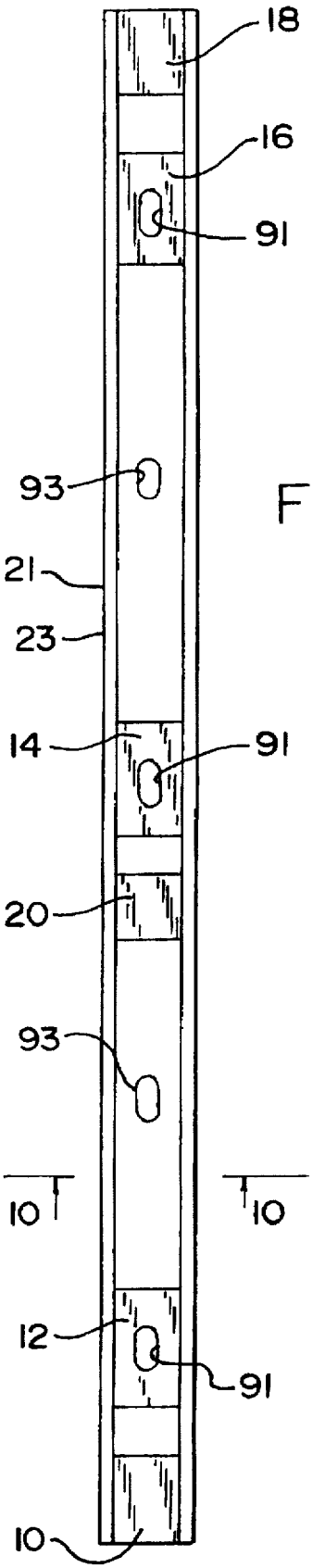
FIG. 8 is a plan view of a member/stud of the invention, commonly used as a stud in the building industry.

In the embodiment shown in FIGS. 4 and 8, as many as five or more inserts (10, 12, 14, 16, and 18) may be secured in the cavity at the positions shown. Such inserts may be of various sizes depending on the particular application. For example inserts 10 and 18 are 4½ inch inserts; insert 12 is a 6 inch insert; and inserts 14 and 16 are 9 inch inserts. The inserts may be located at different intervals. There may be more or less depending on the application.

Figure 3:
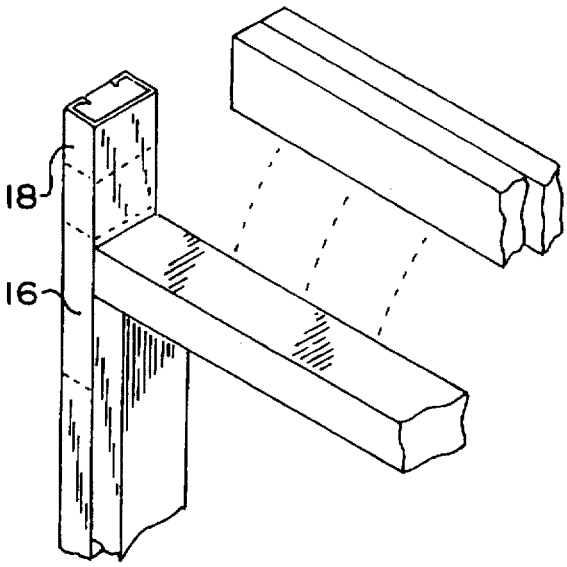
FIG. 3 illustrates a wood header attached to the member/stud and a wood cripple attached to the member/stud.

The frames 23 of FIGS. 3, 4, 6, and 8 show openings 91 for the receiving of electrical wiring. As the openings are in the soft material inserts it is believed that such soft material will not fray the wiring which could occur were these holes in the metal. The metal frame 23 of FIGS. 3 and 8 show openings 93 for receiving of plumbing pipes and such.

Figure 1:
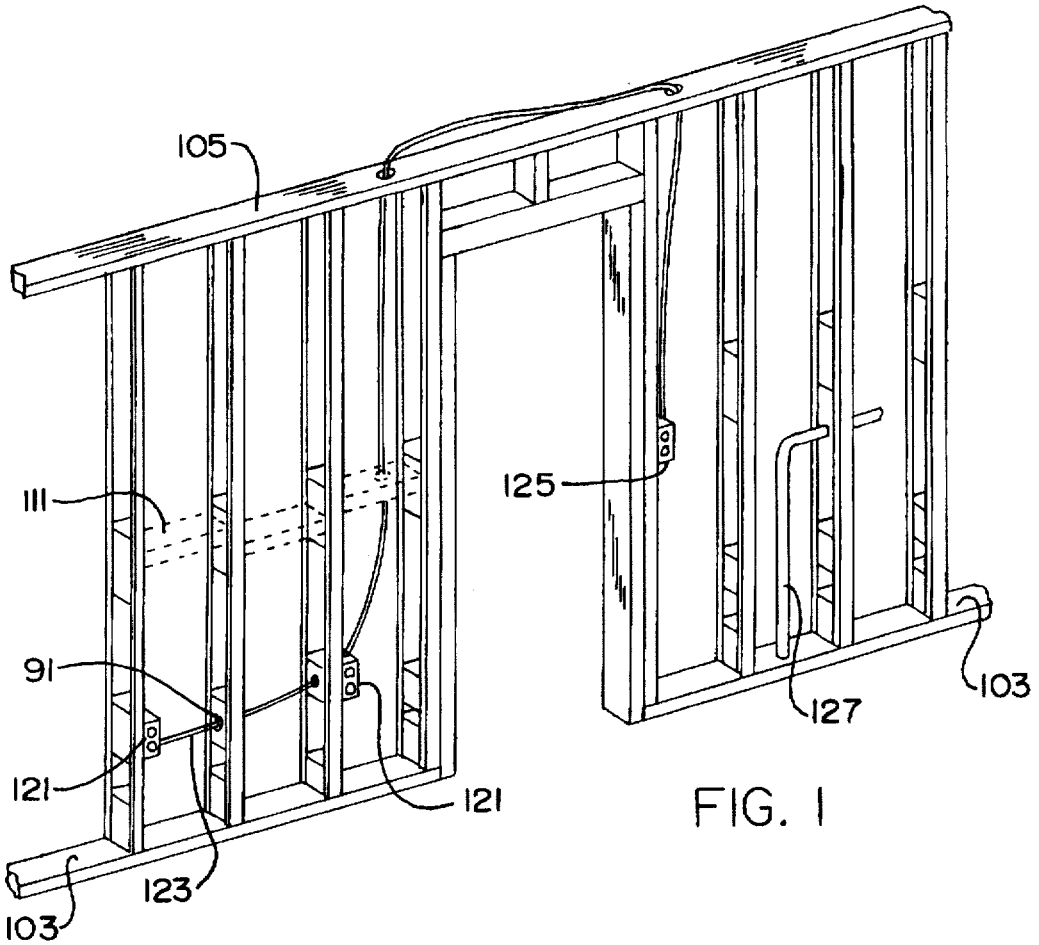
FIG. 1 illustrates a wall of structural or non-structural members/studs of the invention used as studs to form a wall in a commercial or residential building using wood top and bottom plate material with common wiring and plumbing techniques.
Figure 2:
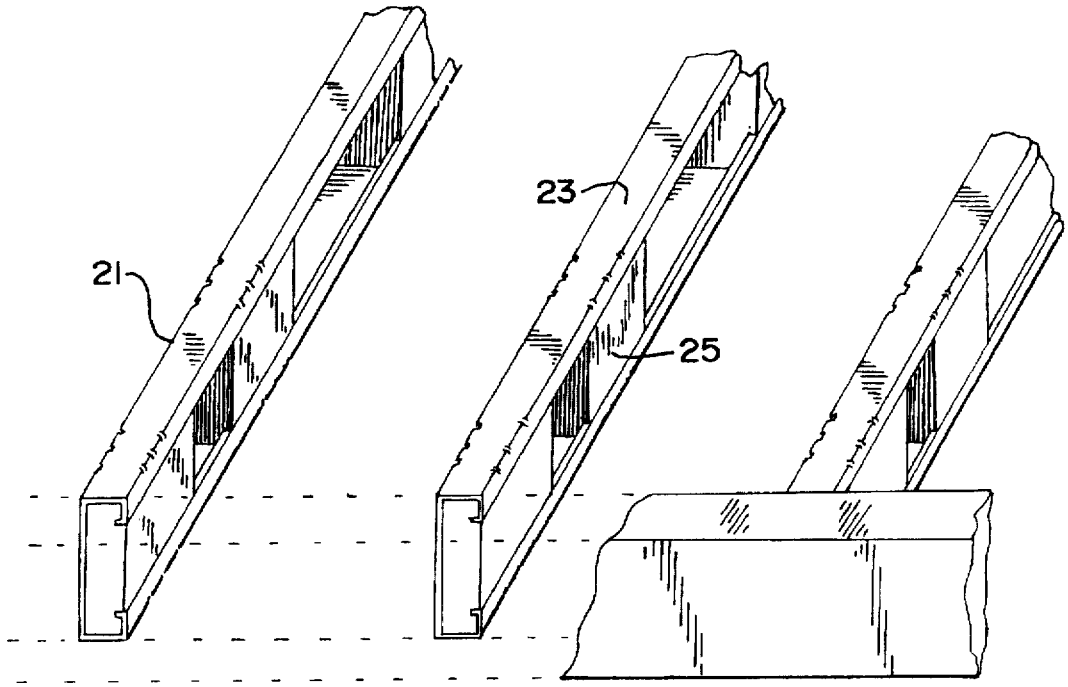
FIG. 2 illustrates the bottom end of the member/stud attached to a bottom wooden plate. The technique known as "toe nailing" is illustrated.

The studs 21 may be secured to the bottom wooden plate 103 and to the top wooden plate 105 by driving nails through the lower and upper inserts 10 and 18 and into the plates 103 and 105 as shown FIG. 1.

Electrical plug boxes 121 and similar wall plugs can be connected to the stud inserts 12 and 14. Holes 91 are drilled through the inserts for passage of electrical leads 123 through the holes 91 and through frame holes as shown in FIGS. 3, 4, 6, and 8. The insert holes 91 will prevent the electrical leads from contacting the frame as there is blocking at these points. An electrical switch box can be installed in the stud insert. Plumbing 127 can be inserted through the uncovered frame holes 93.

Nails, screws and other fastening means may be used to attach other structures to the wood portion of the stud. Once the wall is framed, sheet rock and/or paneling can be nailed to the inserts 25 on the inside walls with conventional nails at the blocked areas and screws at the unblocked areas. On the exterior, outer walls, panels, and/or sheathing can be secured to the frame by nailing at the inserts or blocking points and using screws in between where the inserts or blocking do not exist.

In the description of FIG. 3, the metal frames 23 with specifically located inserts provide a means to use softer materials to hold a nail or fastener to specs. Screws also can be threaded into the inserts or metal frame only.

The inserts 25 securely hold such fastening means in place and provide additional support for the metal frames mainly at the top and bottom inserts as to not allow the metal stud to penetrate or sink into the top or bottom plate. For the stud 21, the inserts 10 and 18 are used to secure the stud to the bottom and top plates. The inserts 12 and 14 are used to support electrical boxes and receptacles. The insert 16 is used to secure the cripple thereto. The inserts 10, 12, 14, 16, 18 may be used to secure interior four foot sheet rock thereto and also exterior paneling, sheathing, or wall coverings.

I claim:

1. A stud for building structures that use stud, top plate and a bottom plate construction, said stud comprising: an elongated metal member having a top end and a bottom end, a main wall having two side walls extending from said main wall and parallel to one another so as to form a C shaped cross section and having a opening running from said top end to said bottom end of said stud, said metal member having a length adapted to extend from the top plate to the bottom plate of standard building frameworks so that said metal portion will support a load on said top plate; said main wall having at least one stud aperture in said main wall and having a bottom insert of composite material in connection with said bottom end, and a top insert of composite material in connection with said top end, said inserts of shape adapted to fit within said cross section and each having at least one relatively flat surface and a third, intermediate insert of composite material, said intermediate insert having at least one insert aperture adapted to support plumbing conduits and electrical wiring used in the building industry, said insert aperture having a smaller size than said stud aperture so as to prevent the fraying of electrical wiring, and said insert aperture in alignment with said stud aperture and said opening of said metal member.

2. The stud of claim 1 where such composite material is chosen from among the following materials: composite plastic.

3. The stud of claim 2 having a fourth, intermediate insert of composite material, said intermediate insert having at least one insert aperture adapted to support plumbing conduits and electrical wiring used in the building industry, said insert aperture of smaller size than said stud aperture so as to prevent the fraying of electrical wiring, said insert aperture in alignment with said stud aperture and said opening.

4. The stud of claim 3 wherein said main wall has indentations for securing said inserts.

* * * * *